US009123992B2

(12) United States Patent
Lee

(10) Patent No.: US 9,123,992 B2
(45) Date of Patent: Sep. 1, 2015

(54) MICRO-MINIATURE BASE STATION ANTENNA HAVING DIPOLE ANTENNA

(71) Applicant: Electronics and Telecommunications Research Institute, Daejeon (KR)

(72) Inventor: Jung Nam Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 273 days.

(21) Appl. No.: 13/718,448

(22) Filed: Dec. 18, 2012

(65) Prior Publication Data

US 2014/0118212 A1 May 1, 2014

(30) Foreign Application Priority Data

Oct. 31, 2012 (KR) ..... 10-2012-0121905

(51) Int. Cl.
*H01Q 9/28* (2006.01)
*H01Q 1/24* (2006.01)

(52) U.S. Cl.
CPC ..... *H01Q 9/285* (2013.01); *H01Q 1/246* (2013.01)

(58) Field of Classification Search
CPC ..... H01Q 9/285; H01Q 9/28
USPC ..... 343/795, 741, 789, 744, 749, 700 MS, 343/742
See application file for complete search history.

(56) References Cited

U.S. PATENT DOCUMENTS

| | | | | |
|---|---|---|---|---|
| 6,028,563 | A | 2/2000 | Higgins | |
| 6,072,439 | A | 6/2000 | Ippolito et al. | |
| 6,373,446 | B2 * | 4/2002 | Apostolos | 343/797 |
| 6,888,510 | B2 * | 5/2005 | Jo et al. | 343/797 |
| 7,436,369 | B2 * | 10/2008 | Apostolos | 343/741 |
| 7,623,075 | B2 * | 11/2009 | Apostolos | 343/700 MS |
| 7,692,601 | B2 | 4/2010 | Bisiules et al. | |
| 7,847,747 | B2 * | 12/2010 | Apostolos | 343/742 |
| 8,618,998 | B2 * | 12/2013 | Kikin | 343/795 |

FOREIGN PATENT DOCUMENTS

| | | |
|---|---|---|
| KR | 10-0826115 | 4/2008 |
| KR | 1020080033660 | 4/2008 |

* cited by examiner

*Primary Examiner* — Huedung Mancuso
(74) *Attorney, Agent, or Firm* — Nelson Mullins Riley & Scarborough LLP

(57) ABSTRACT

The micro-miniature base station antenna with a dipole antenna includes a hexahedral cube with a cavity structure, a dielectric substrate that is disposed on an inner lower surface of the cube, four pairs of supporters that are connected to the dielectric substrate to be formed in a direction perpendicular to the dielectric substrate, a first power feeding unit that includes one side connected to the dielectric substrate and the other side having a curved shape, a second power feeding unit that includes one side connected to the dielectric substrate and the other side having a curved shape, and is formed in a direction crossing the first power feeding unit, and four emitters in which one of the four emitters is coupled to an upper surface of a single pair of supporters among the four pairs of supporters.

7 Claims, 8 Drawing Sheets

MICRO-MINIATURE BASE STATION ANTENNA HAVING DIPOLE ANTENNA

CLAIM FOR PRIORITY

This application claims priority to Korean Patent Application No. 10-2012-0121905 filed on Oct. 31, 2012 in the Korean Intellectual Property Office (KIPO), the entire contents of which are hereby incorporated by reference.

BACKGROUND

1. Technical Field

Example embodiments of the present invention relate in general to an antenna, and more specifically, to a micro-miniature base station antenna that includes a dipole antenna with high isolation.

2. Related Art

In the wireless communication market, with increasing saturation of wireless communication and user demand for faster services, a trend for rapidly increasing mobile traffic and new mobile services is emerging.

As a variety of wireless communication technologies such as 2G, 3G, 4G and the like, is being developed, the number of base stations and antennas is increasing with the development of such wireless communication technologies, and sizes and costs of radio frequency (RF) and antennas are increasing.

As a result, a variety of wireless communications is used by a single base station, and a micro-miniature base station in which a small size and an economic and environmental friendly concept are considered, has emerged.

Since the micro-miniature base station has no base station, an installation area is not required, power loss caused by a transmission line is minimized, and low power consumption and application of coordinated multi-points are achieved.

In addition, due to its small size, the micro-miniature base station may be installed anywhere power sources and the Internet are connected with each other, such as fronts of buildings, bus-stops, telephone poles, streetlights, and the like.

Meanwhile, the key technology of the micro-miniature base station is that RF and antennas are built in a single small rectangular cube to thereby miniaturize the base station, and particularly, miniaturization of the antenna is more important than anything.

However, a dual-polarized antenna that uses electric field/magnetic field in order to increase channel capacity is used, but it is difficult to configure two antennas within a cube having spatial constraints rather than free space.

In addition, when the antenna is inserted into a cube made of a metal, conditions of boundary surfaces are changed to cause changes in characteristics of the antenna, and therefore the size of the antenna should be reduced. As a result, there are problems where bandwidth becomes narrower, and gain is lowered.

SUMMARY

Accordingly, example embodiments of the present invention are provided to substantially obviate one or more problems due to limitations and disadvantages of the related art.

Example embodiments of the present invention provide a micro-miniature base station antenna including a dipole antenna that may be mounted within a metal cube and have a wide bandwidth, high isolation, and high gain.

In some example embodiments, a micro-miniature base station antenna with a dipole antenna includes: a hexahedral cube with a cavity structure; a dielectric substrate that is disposed on an inner lower surface of the cube; four pairs of supporters that are connected to the dielectric substrate to be formed in a direction perpendicular to the dielectric substrate; a first power feeding unit that includes one side connected to the dielectric substrate and the other side having a curved shape; a second power feeding unit that includes one side connected to the dielectric substrate and the other side having a curved shape, and is formed in a direction crossing the first power feeding unit; and four emitters in which one of the four emitters is coupled to an upper surface of a single pair of supporters among the four pairs of supporters.

Here, the other side of the first power feeding unit may be formed in the curved shape so as to face the dielectric substrate.

Here, the other side of the second power feeding unit may be formed in the curved shape so as to face the dielectric substrate.

Here, the four emitters may be perpendicularly spaced apart from one of the first power feeding unit and the second power feeding unit, and be positioned above the first power feeding unit and the second power feeding unit.

Here, each of the four emitters may be formed in at least one of a trapezoid shape, a quadrate shape, a rectangular shape, a diamond shape, a circular shape, and an elliptical shape.

Here, the length of the power feeding unit may be fixed in accordance with an isolation degree, and the length of the curved shape of the second power feeding unit may be changed.

Here, the length or area of each of the four emitters may be changed in accordance with a pass frequency band.

Here, the length of each of the first power feeding and the second power feeding unit may be changed in accordance with a matching degree of the micro-miniature station antenna.

BRIEF DESCRIPTION OF DRAWINGS

Example embodiments of the present invention will become more apparent by describing in detail example embodiments of the present invention with reference to the accompanying drawings, in which.

DESCRIPTION OF EXAMPLE EMBODIMENTS

Figure 1:
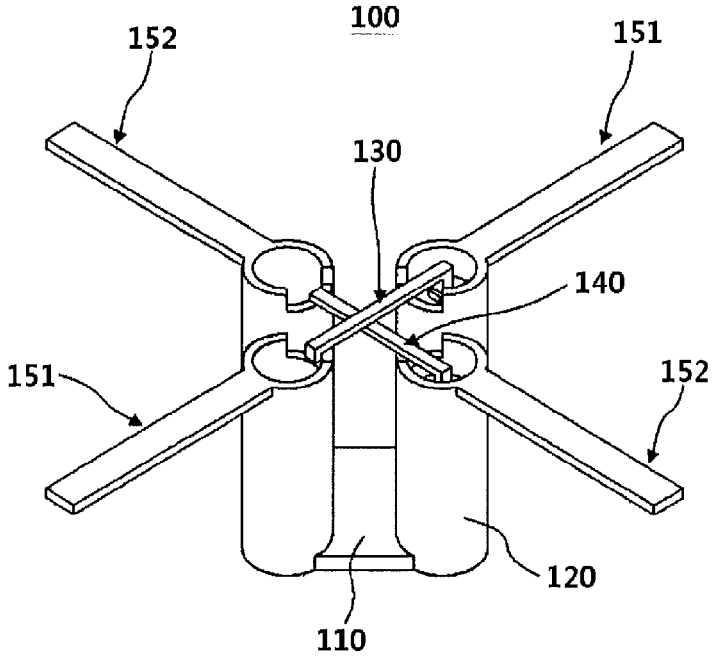
FIG. 1 is a perspective view showing a base station antenna.

Example embodiments of the present invention are described below in sufficient detail to enable those of ordinary skill in the art to embody and practice the present invention. It is important to understand that the present invention may be embodied in many alternate forms and should not be construed as limited to the example embodiments set forth herein.

Accordingly, while the invention can be modified in various ways and take on various alternative forms, specific embodiments thereof are shown in the drawings and described in detail below as examples. There is no intent to limit the invention to the particular forms disclosed. On the contrary, the invention is to cover all modifications, equivalents, and alternatives falling within the spirit and scope of the appended claims. Elements of the example embodiments are consistently denoted by the same reference numerals throughout the drawings and detailed description.

It will be understood that, although the terms first, second, A, B, etc. may be used herein in reference to elements of the invention, such elements should not be construed as limited by these terms. For example, a first element could be termed a second element, and a second element could be termed a first element, without departing from the scope of the present invention. Herein, the term "and/or" includes any and all combinations of one or more referents.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements. Other words used to describe relationships between elements should be interpreted in a like fashion (i.e., "between" versus "directly between," "adjacent" versus "directly adjacent," etc.).

The terminology used herein to describe embodiments of the invention is not intended to limit the scope of the invention. The articles "a," "an," and "the" are singular in that they have a single referent, however the use of the singular form in the present document should not preclude the presence of more than one referent. In other words, elements of the invention referred to in the singular may number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art to which this invention belongs. It will be further understood that terms in common usage should also be interpreted as is customary in the relevant art and not in an idealized or overly formal sense unless expressly so defined herein.

It should also be noted that in some alternative implementations, operations may be performed out of the sequences depicted in the flowcharts. For example, two operations shown in the drawings to be performed in succession may in fact be executed substantially concurrently or even in reverse of the order shown, depending upon the functionality/acts involved.

FIG. 1 is a perspective view showing a base station antenna.

Referring to FIG. 1, a base station antenna 100 includes a grounding unit 110 that grounds signals, a pair of balun units 120 that are vertically formed by being connected to the grounding unit 110, a pair of power feeding units 130 and 140 that are formed corresponding to the pair of balun units 120, and dipole branches 151 and 152 that are formed in an X-shape at distal ends that face the pair of power feeding units 130 and 140.

The base station antenna 100 may generate dual polarization by the dipole branches 151 and 152 which are formed in the X-shape at the distal ends facing the pair of power feeding units 130 and 140 crossing each other.

However, since the dipole branches 151 and 152 are formed to have a length of $\lambda/2$ of a frequency to thereby become large in their sizes, the base station antenna 100 may be applied to only a base station array antenna, and is not mounted in the cube made of metal.

In addition, since an additional balun is mounted in the base station antenna 100, the height of the antenna is high and the power feeding units 130 and 140 crossing each other are fixed, and therefore isolation characteristics are deteriorated.

Figure 2:
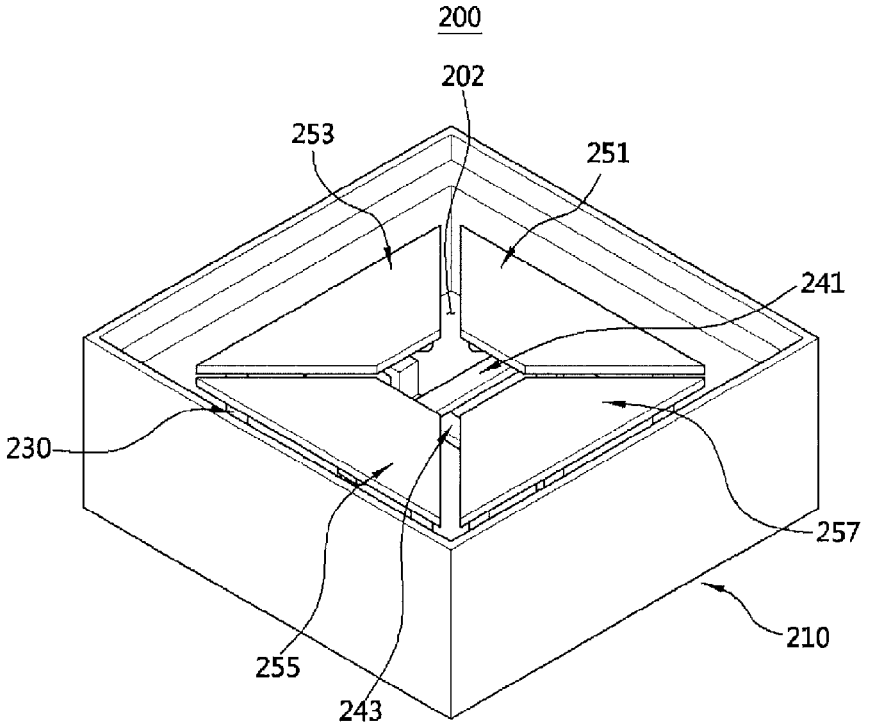
FIG. 2 is a perspective view showing a micro-miniature base station antenna with a dipole antenna according to an embodiment of the present invention.

FIG. 2 is a perspective view showing a micro-miniature base station antenna with a dipole antenna according to an embodiment of the present invention.

Referring to FIG. 2, a micro-miniature base station antenna 200 with a dipole antenna according to an embodiment of the present invention configures an electric field/magnetic field trapezoidal dipole antenna for inducing dual polarization into a small-sized hexahedral cube 210 made of a metal or aluminum, and enables trapezoidal emitters 250*a*, 250*b*, 250*c*, and 250*d* and power feeding units 240*a* and 240*b* to be perpendicularly spaced apart from each other to thereby form an air layer by an arbitrary distance, thereby inducing a coupling phenomenon.

In addition, the micro-miniature base station antenna 200 may induce a matching of an antenna by adjusting the length of each of the power feeding units 240*a* and 240*b*, improve isolation characteristics between dipole antennas by adjusting the interval by which the first power feeding unit 240*a* and the second power feeding unit 240*b* are perpendicularly spaced apart from each other, and move a frequency by adjusting the width and the length of each of the trapezoidal emitters 250*a*, 250*b*, 250*c*, and 250*d*.

Therefore, the micro-miniature base station antenna 200 with the dipole antenna according to an embodiment of the present invention may be mounted within the hexahedral cube 210 to thereby have a wide bandwidth, high isolation, and high gain even though the micro-miniature base station antenna 200 has a small size.

Figure 3:
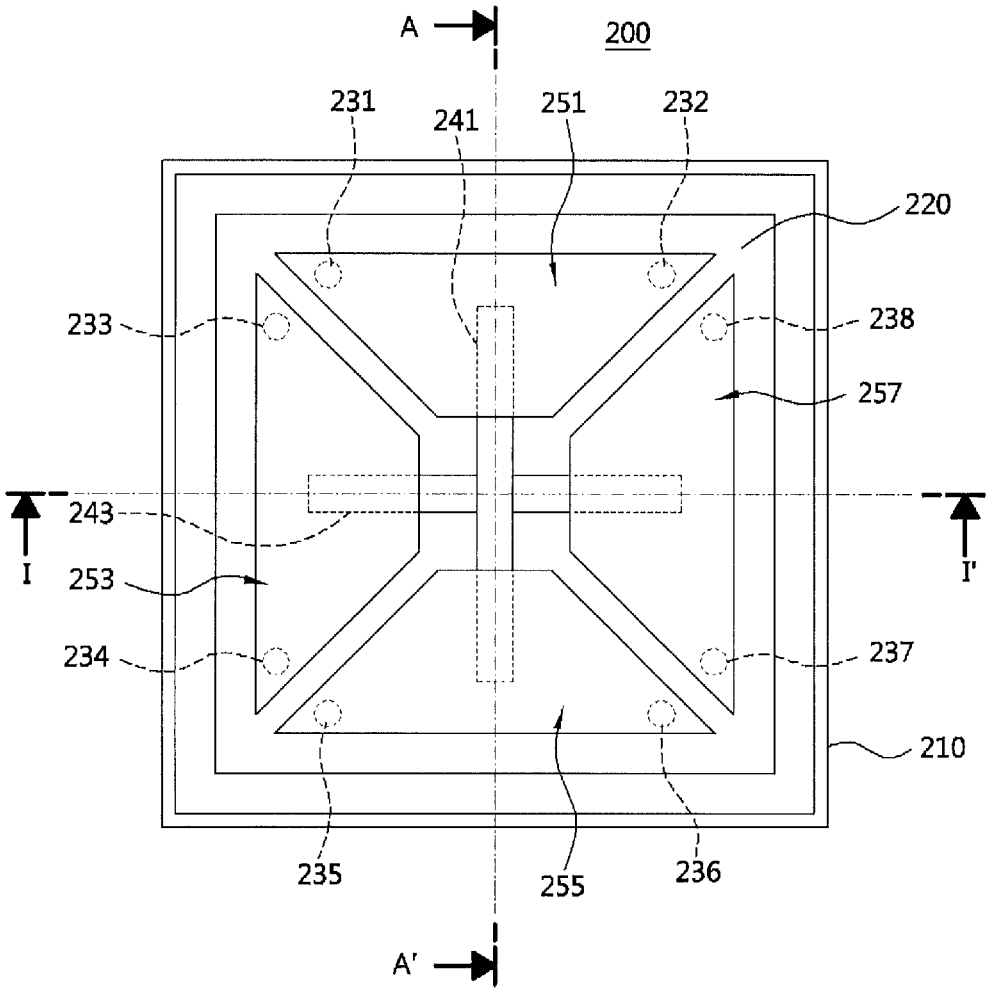
FIG. 3 is a perspective view obtained when an upper surface of a micro-miniature base station antenna with the dipole antenna according to an embodiment of the present invention is horizontally viewed.

FIG. 3 is a perspective view obtained when an upper surface of a micro-miniature base station antenna with the dipole antenna according to an embodiment of the present invention is horizontally viewed.

Referring to FIG. 3, the micro-miniature base station antenna 200 with the dipole antenna according to an embodiment of the present invention includes a first power feeding unit 241 and a second power feeding unit 243 which are formed in a direction of crossing each other.

In addition, a trapezoidal emitter 250 may include four trapezoidal emitters 251, 253, 255, and 257, and one trapezoidal emitter is coupled to an upper surface of a pair of supporters.

Specifically, the first trapezoidal emitter 251 is coupled to an upper surface of each of the supporters 231 and 233, and the second trapezoidal emitter 253 is coupled to an upper surface of each of supporters 233 and 234. In addition, the third trapezoidal emitter 255 is coupled to an upper surface of each of supporters 235 and 236, and the fourth trapezoidal emitter 257 is coupled to an upper surface of each of supporters 237 and 238.

In addition, in an embodiment of the present invention, the trapezoidal emitter 250 has been described as an example, but in other embodiments, the emitter may be formed in a quadrate shape, a rectangular shape, a diamond shape, a circular shape, an elliptical shape, or the like.

Figure 4:
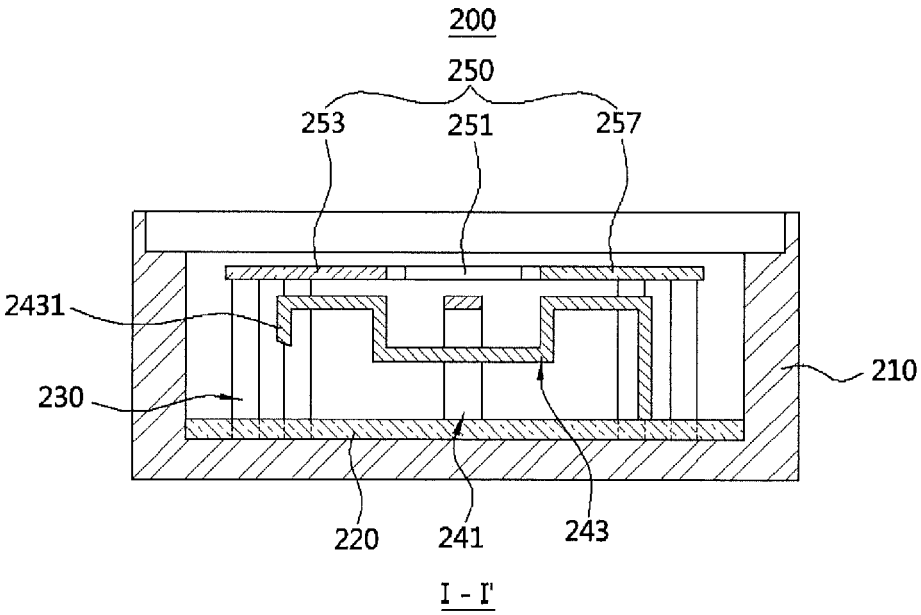
FIG. 4 is a side cross-sectional view showing a cross-section cut along line I-I' of the micro-miniature base station antenna with the dipole antenna shown in FIG. 3.

FIG. 4 is a side cross-sectional view showing a cross-section cut along line I-I' of the micro-miniature base station antenna with the dipole antenna shown in FIG. 3.

Referring to FIG. 4, the micro-miniature base station antenna 200 with the dipole antenna according to an embodiment of the present invention includes a hexahedral cube 210, a dielectric substrate 220, a supporter 230, a power feeding unit 240, and a trapezoidal emitter 250.

First, the hexahedral cube 210 may be made of a metal such as aluminum or the like, so as not to be affected by external electromagnetic waves and the like, and has a cavity structure.

The dielectric substrate 220 is disposed on an inner lower surface of the hexahedral cube, and connected with one side of the first and second power feeding units 241 and 243 and the supporter 230.

The supporter 230 includes one side connected to the dielectric substrate 220 so as to be formed in a direction perpendicular to the dielectric substrate 220.

In addition, the supporter 230 may have a cylindrical structure, and formed of four pairs. One side of the four pairs of supporters may be connected with the dielectric substrate 220, and the other side thereof may be connected with a lower surface of the trapezoidal emitter 250. Two supporters may be connected with a single trapezoidal emitter 250, and eight supporters may be connected with four trapezoidal emitters 250.

The power feeding unit 240 may include first and second power feeding units 241 and 243.

The first power feeding unit 241 is connected at its one side to the dielectric substrate 220, and is formed in a direction that is spaced apart from the second power feeding unit 243, and crosses the second power feeding unit 243.

The second power feeding unit 243 includes one side connected with the dielectric substrate 220, and the other side formed in a curved shape 2431. In addition, the second power feeding unit 243 is formed in a direction crossing the first power feeding unit 241.

Here, the curved shape 2431 of the second power feeding unit 243 is formed so as to face the dielectric substrate 220.

The trapezoidal emitter 250 may be perpendicularly spaced apart from one of the first power feeding unit 241 and the second power feeding unit 243, and include four trapezoidal emitters. A single trapezoidal emitter may be coupled to an upper surface of a pair of supporters among the four pairs of supporters 230.

The micro-miniature base station antenna 200 with the dipole antenna according to an embodiment of the present invention may have desired isolation characteristics by changing only the curved shape 2431 in a state of fixing the first power feeding unit 241, and adjust a desired frequency band by changing the width and/or length of the trapezoidal emitter 250.

In addition, in an embodiment of the present invention, the trapezoidal emitter 250 has been described as an example, but in other embodiments, the emitter may be formed in a quadrate shape, a rectangular shape, a diamond shape, a circular shape, an elliptical shape, or the like.

Figure 5:
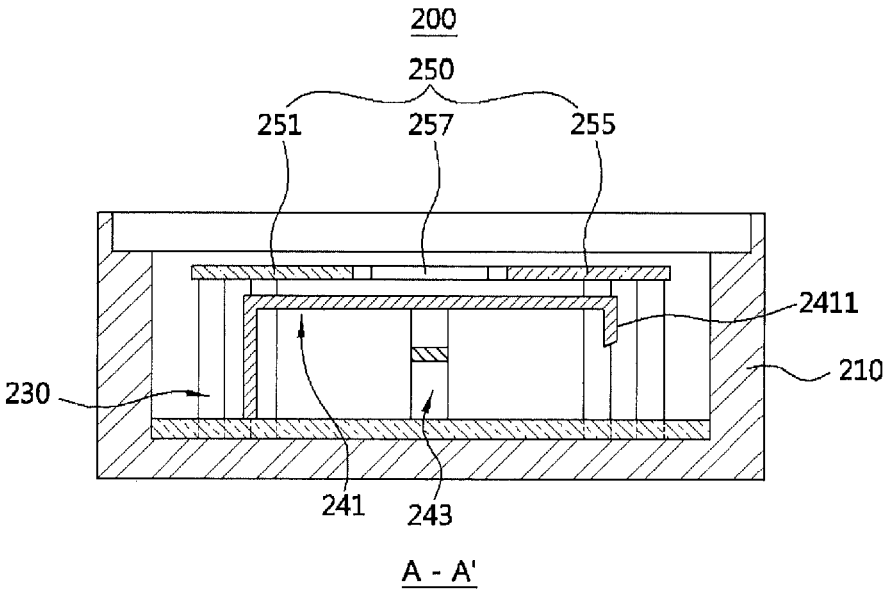
FIG. 5 is a side cross-sectional view showing a cross-section cut along line A-A' of the micro-miniature base station antenna with the dipole antenna shown in FIG. 3.

FIG. 5 is a side cross-sectional view showing a cross-section cut along line A-A' of the micro-miniature base station antenna with the dipole antenna shown in FIG. 3.

Referring to FIG. 5, the micro-miniature base station antenna 200 with the dipole antenna according to an embodiment of the present invention includes a hexahedral cube 210, a dielectric substrate 220, a supporter 230, and a trapezoidal emitter 250.

First, the hexahedral cube 210 may be made of a metal or aluminum, and have a cavity structure.

The dielectric substrate 220 is disposed on an inner lower surface of the hexahedral cube 210, and connected with one side of a first power feeding unit 241, a second power feeding unit 243, and the supporter 230.

The supporter 230 is connected at its one side to the dielectric substrate 220 to be formed in a direction perpendicular to the dielectric substrate 220.

In addition, the supporter 230 may have a cylindrical shape and include four pairs. In addition, the supporter 230 may be connected at its one side with the dielectric substrate 220, and connected at the other side with a lower surface of the trapezoidal emitter 250. Two supporters may be connected with a single trapezoidal emitter 250, and eight supporters may be connected with four trapezoidal emitters 250.

The power feeding unit 240 may include a first power feeding unit 241 and a second power feeding unit 243.

The first power feeding unit 241 includes one side connected to the dielectric substrate 220, and the other side having a curved shape. In addition, the first power feeding unit 241 is formed in a direction crossing the second power feeding unit 243.

Here, the curved shape 2411 of the first power feeding unit 241 is formed so as to face the dielectric substrate 220.

The second power feeding unit 243 is connected at its one side to the dielectric substrate 220, and formed in a direction crossing the first power feeding unit 241.

The trapezoidal emitter 250 may be perpendicularly spaced apart from one of the first power feeding unit 241 and the second power feeding unit 243, and include four trapezoidal emitters. Here, a single trapezoidal emitter may be connected to the upper surface of a pair of supporters of four pairs of supporters 230.

The micro-miniature base station antenna 200 with the dipole antenna according to an embodiment of the present invention may have desired isolation characteristics by changing only the curved shape 2411 of the first power feeding unit 241 in a state of fixing the second power feeding unit 243, and adjust a desired frequency band by changing the width and/or length of the trapezoidal emitter.

Figure 6:
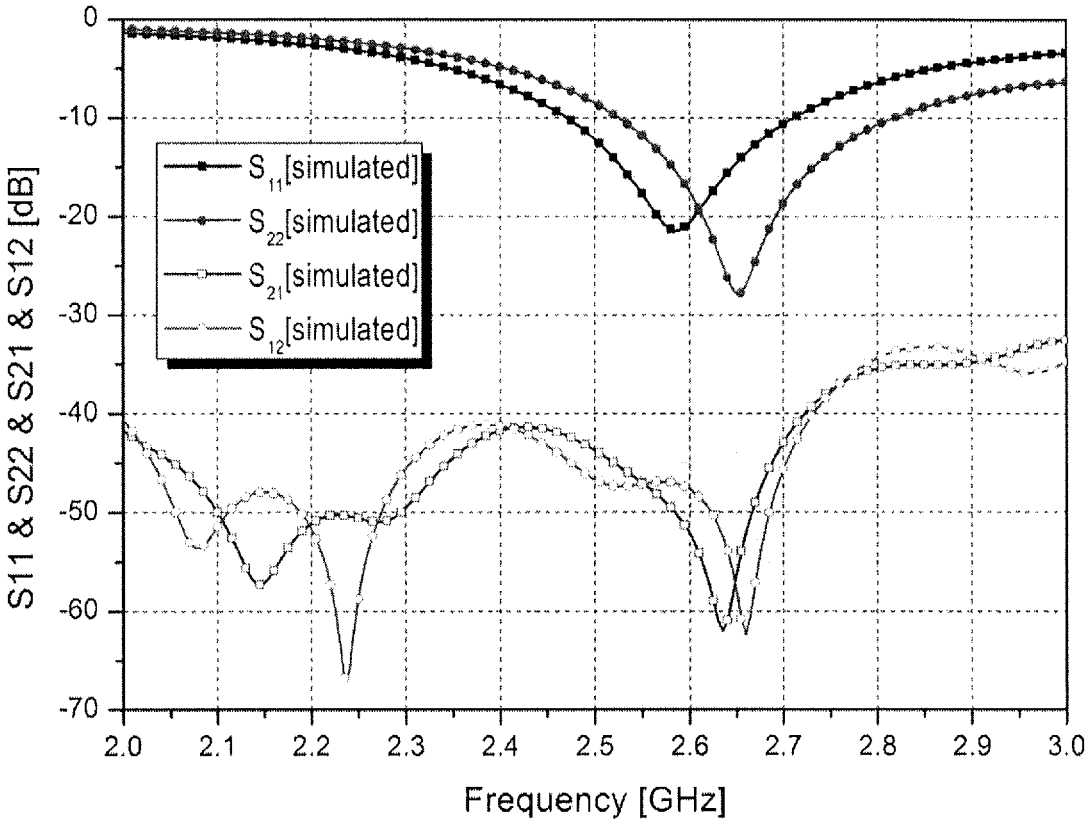
FIG. 6 is a graph showing reflection loss and isolation characteristics of a micro-miniature base station antenna with a dipole antenna according to an embodiment of the present invention.

FIG. 6 is a graph showing reflection loss and isolation characteristics of a micro-miniature base station antenna with a dipole antenna according to an embodiment of the present invention.

Referring to FIG. 6, a frequency bandwidth of the micro-miniature base station antenna 200 with the dipole antenna according to an embodiment of the present invention exhibits broadband characteristics of about 200 MHz of 2.5 GHz to 2.7 GHz, and emitted frequencies based on signals excited in the first power feeding unit 241 and the second power feeding unit 243 are equally shown.

Here, isolation characteristics between two dipole antennas 251 and 255 and 253 and 257 are significantly high because the isolation degree is −50 dB on average and has a maximum of −62 dB.

Here, an X-axis of the graph with respect to reflection loss and isolation characteristics denotes a frequency GHz, and a Y-axis thereof denotes an S-parameter (dB).

Figure 7:
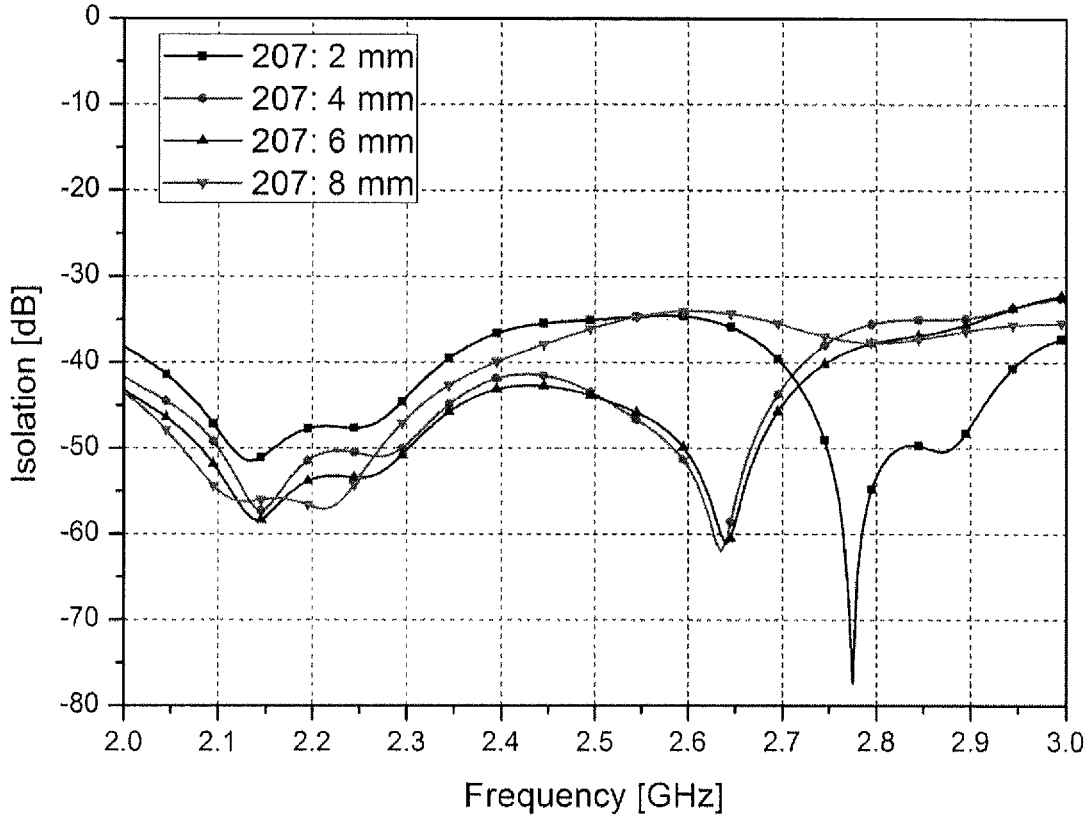
FIG. 7 is a graph showing isolation characteristics when the length of a curved shape of a second power feeding unit is changed in a micro-miniature base station antenna with a dipole antenna according to an embodiment of the present invention.

FIG. 7 is a graph showing isolation characteristics when the length of a curved shape of a second power feeding unit is changed in a micro-miniature base station antenna with a dipole antenna according to an embodiment of the present invention.

Referring to FIG. 7, a frequency bandwidth of the micro-miniature base station antenna 200 with the dipole antenna according to an embodiment of the present invention exhibits broadband characteristics of about 200 MHz of 2.5 GHz to 2.7 GHz, and emitted frequencies based on signals excited in the first power feeding unit 241 and the second power feeding unit 243 are equally shown.

The micro-miniature base station antenna 200 with the dipole antenna may obtain desired isolation characteristics by changing only a curved shape of the second power feeding unit 243 in a state of fixing the first power feeding unit 241.

Here, when the length of the curved shape of the second power feeding unit 243 is increased, an interval with the first power feeding unit 241 is increased, and therefore interference between the first and second power feeding units 241 and 243 is reduced, thereby improving isolation characteristics. However, when the length of the curved shape of the second power feeding unit 243 is increased by a predetermined reference or more, the curved shape of the second power feeding unit 243 is close to the dielectric substrate 220, and therefore isolation characteristics are deteriorated.

Figure 8:
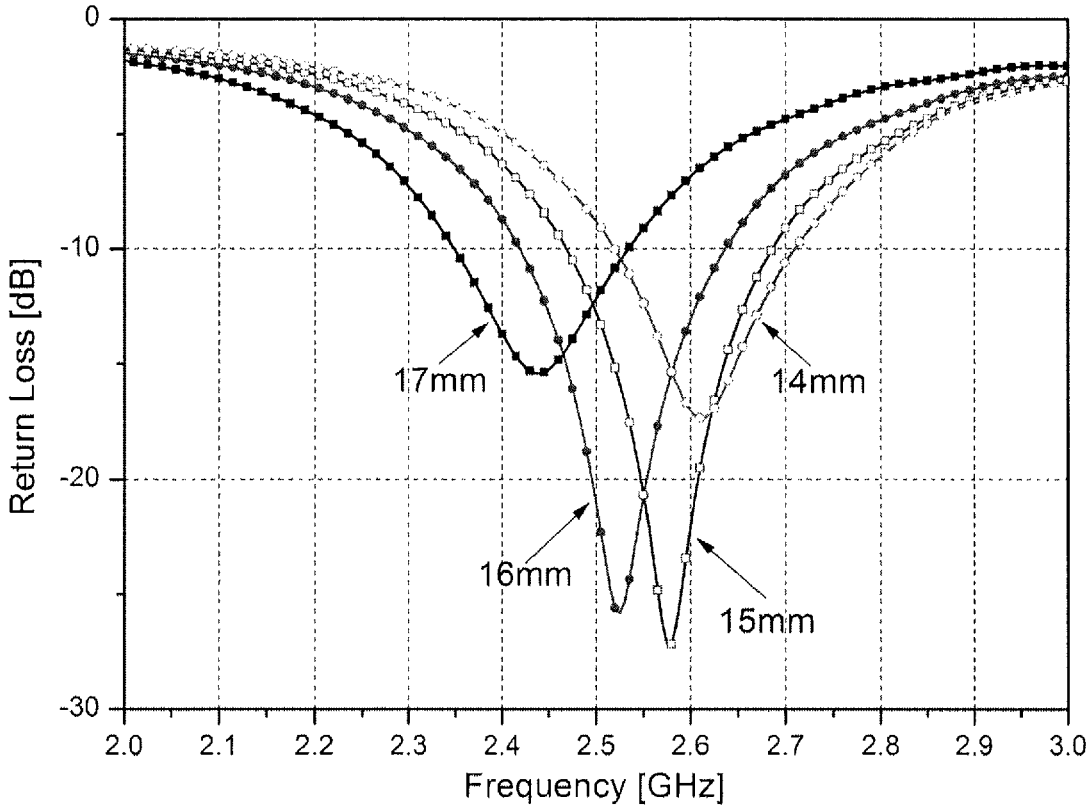
FIG. 8 is a graph showing reflection loss characteristics when the length and area of a trapezoid-shaped emitter are changed in a micro-miniature base station antenna with a dipole antenna according to an embodiment of the present invention.

FIG. 8 is a graph showing reflection loss characteristics when the length and the area of a trapezoid-shaped emitter are changed in a micro-miniature base station antenna with a dipole antenna according to an embodiment of the present invention.

Referring to FIG. 8, in the micro-miniature base station antenna 200 with the dipole antenna according to an embodiment of the present invention, a pass frequency band is moved to the right side when the length of the trapezoidal emitter 250 is changed to 17 mm, 16 mm, 15 mm, and 14 mm.

Therefore, the micro-miniature base station antenna 200 with the dipole antenna according to an embodiment of the present invention may obtain a desirable frequency band by changing the length of the trapezoidal emitter 250.

Figure 9:
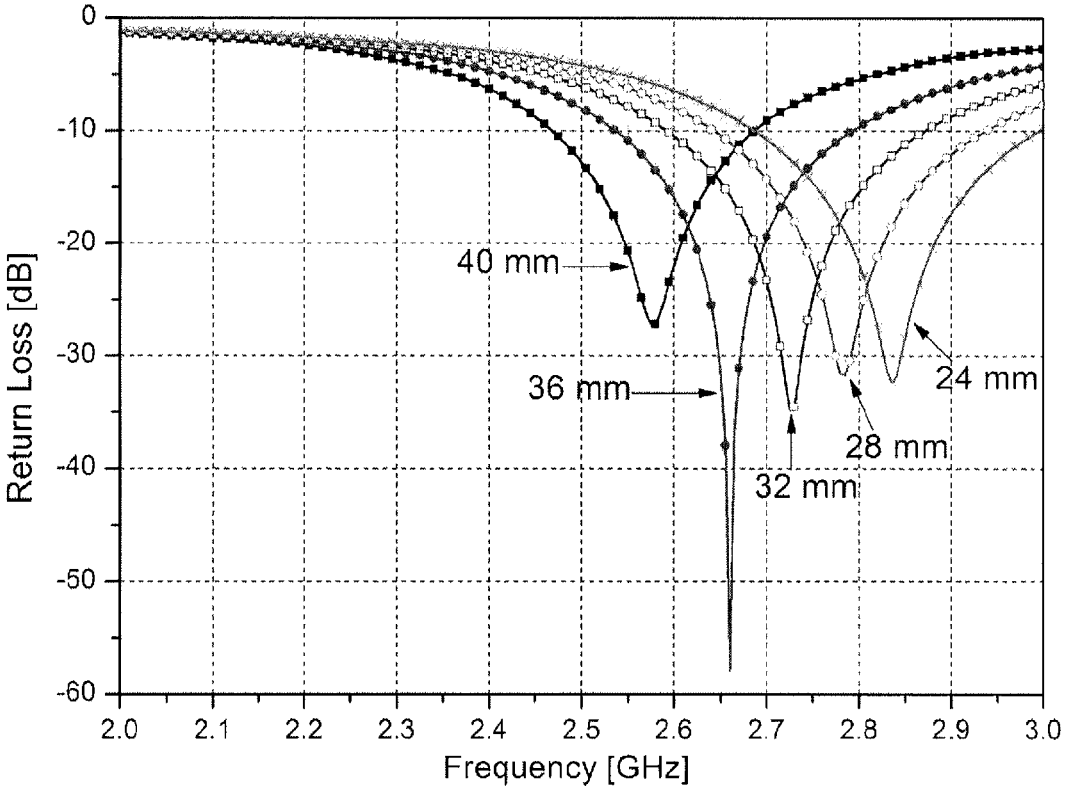
FIG. 9 is a graph showing reflection loss characteristics when the area of the trapezoid-shaped emitter is changed in a micro-miniature base station antenna with a dipole antenna according to an embodiment of the present invention.

FIG. 9 is a graph showing reflection loss characteristics when the area of the trapezoid-shaped emitter is changed in a micro-miniature base station antenna with a dipole antenna according to an embodiment of the present invention.

Referring to FIG. 9, in the micro-miniature base station antenna 200 with the dipole antenna according to an embodiment of the present invention, a pass frequency band is moved to the right side when the width of the trapezoidal emitter 250 is changed to 40 mm, 36 mm, 32 mm, 28 mm, and 24 mm.

Therefore, the micro-miniature base station antenna 200 with the dipole antenna according to an embodiment of the present invention may obtain a desirable frequency band by changing the width of the trapezoidal emitter 250.

Figure 10:
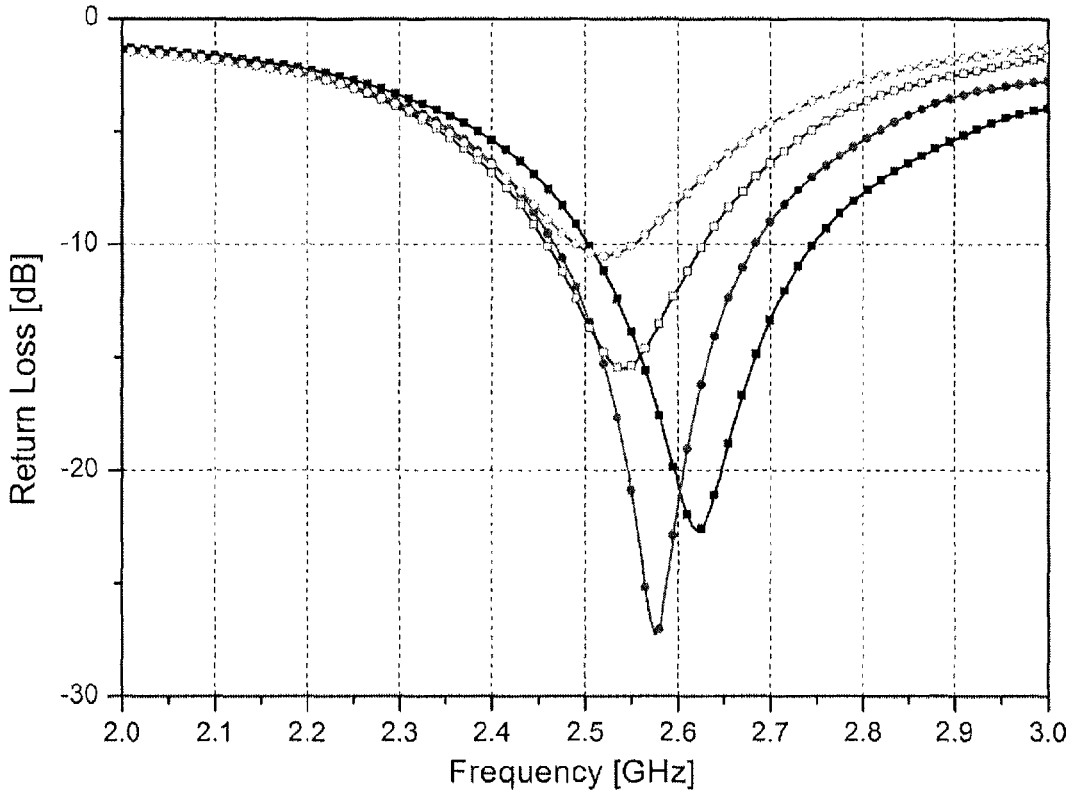
FIG. 10 is a graph showing reflection loss characteristics when the length of power feeding units crossing each other is changed in a micro-miniature base station antenna with a dipole antenna according to an embodiment of the present invention.

FIG. 10 is a graph showing reflection loss characteristics when the length of a power feeding units crossing each other is changed in a micro-miniature base station antenna with a dipole antenna according to an embodiment of the present invention.

Referring to FIG. 10, in the micro-miniature base station antenna 200 with the dipole antenna according to an embodiment of the present invention, the matching degree of an antenna may differ when the lengths of the first and second power feeding units 241 and 243 crossing each other are changed to the same length.

Therefore, the micro-miniature base station antenna 200 with the dipole antenna according to an embodiment of the present invention may adjust the matching degree of the antenna by changing the lengths of the first and second power feeding units 241 and 243 to the same length.

As described above, in the micro-miniature base station antenna with the dipole antenna according to the embodiments of the present invention may configure the electric field/magnetic field trapezoidal dipole antenna for inducing dual polarization into the small-sized cube made of a metal or aluminum, form the air layer by an arbitrary distance by perpendicularly spacing apart between the emitter and the power feeding unit to thereby induce a coupling phenomenon resulting in an increase in the frequency bandwidth, induce matching of an antenna by adjusting the length of the power feeding unit, improve isolation characteristics between the dipole antennas by adjusting the interval perpendicularly spaced apart between the power feeding units, and move the frequency by adjusting the width and the length of the trapezoidal dipole emitter.

Accordingly, even though the micro-miniature base station antenna has an ultra small size, the micro-miniature base station antenna may obtain wide bandwidth, high isolation, and high gain.

While the example embodiments of the present invention and their advantages have been described in detail, it should be understood that various changes, substitutions and alterations may be made herein without departing from the scope of the invention.

What is claimed is:

1. A micro-miniature base station antenna with a dipole antenna, comprising:

a hexahedral cube with a cavity structure;

a dielectric substrate that is disposed on an inner lower surface of the cube;

four pairs of supporters that are connected to the dielectric substrate to be formed in a direction perpendicular to the dielectric substrate;

a first power feeding unit that includes one side connected to the dielectric substrate and the other side having a curved shape;

a second power feeding unit that includes one side connected to the dielectric substrate and the other side having a curved shape, and is formed in a direction crossing the first power feeding unit; and four emitters in which one of the four emitters is coupled to an upper surface of a single pair of supporters among the four pairs of supporters, wherein the length of the power feeding unit is fixed in accordance with an isolation degree, and the length of the curved shape of the second power feeding unit is changed.

2. The micro-miniature base station antenna of claim 1, wherein the other side of the first power feeding unit is formed in the curved shape so as to face the dielectric substrate.

3. The micro-miniature base station antenna of claim 1, wherein the other side of the second power feeding unit is formed in the curved shape so as to face the dielectric substrate.

4. The micro-miniature base station antenna of claim 1, wherein the four emitters are perpendicularly spaced apart from one of the first power feeding unit and the second power feeding unit, and are positioned above the first power feeding unit and the second power feeding unit.

5. The micro-miniature base station antenna of claim 1, wherein each of the four emitters is formed in at least one of a trapezoid shape, a quadrate shape, a rectangular shape, a diamond shape, a circular shape, and an elliptical shape.

6. The micro-miniature base station antenna of claim 1, wherein the length or area of each of the four emitters is changed in accordance with a pass frequency band.

7. The micro-miniature base station antenna of claim 1, wherein the length of each of the first power feeding and the second power feeding unit is changed in accordance with a matching degree of the micro-miniature station antenna.

* * * * *